United States Patent [19]

Lemesle

[11] 3,990,762

[45] Nov. 9, 1976

[54] ELECTRICAL CONNECTOR, ELECTRICAL TERMINAL AND A METHOD OF MAKING AN ELECTRICAL CONNECTION

[75] Inventor: Jacques Lemesle, Paris, France

[73] Assignee: AMP Incorporated, Harrisburg, Pa.

[22] Filed: Apr. 17, 1975

[21] Appl. No.: 569,124

[30] Foreign Application Priority Data

Apr. 30, 1974 France ..... 74.15098

[52] U.S. Cl. ..... 339/97 R

[51] Int. Cl.[2] ..... H01R 9/08

[58] Field of Search ..... 339/95, 97–99

[56] References Cited

UNITED STATES PATENTS

| | | | |
|---|---|---|---|
| 2,593,743 | 4/1952 | Galvao | 339/97 R |
| 3,014,140 | 12/1961 | Tupper | 339/97 R |
| 3,403,372 | 9/1968 | Stinson, Jr. | 339/97 R |
| 3,477,059 | 11/1969 | Cole | 339/99 R |
| 3,533,049 | 10/1970 | Thompson | 339/99 R |
| 3,760,331 | 9/1973 | Gurley | 339/36 |

FOREIGN PATENTS OR APPLICATIONS

| | | | |
|---|---|---|---|
| 317,652 | 1/1957 | Switzerland | 339/99 R |
| 428,884 | 7/1967 | Switzerland | 339/97 R |
| 618,755 | 2/1949 | United Kingdom | 339/97 R |
| 635,943 | 4/1950 | United Kingdom | 339/97 R |

*Primary Examiner*—Joseph H. McGlynn
*Attorney, Agent, or Firm*—Allan B. Osborne

[57] ABSTRACT

An electrical connector comprises a housing and a terminal having a slot into which an insulated electrical wire can be forced by inserting the terminal into the housing, after the wire has been inserted into a guide channel in the housing. The insulation of the wire is severed by the walls of the slot to make electrically conductive between the metal core of the wire and the terminal. As the terminal is inserted into the housing, the wire is forced against a resilient pressure member extending from a wall of the housing, the pressure member serving, after the insertion of the terminal into the housing to bear resiliently against the wire to hold it in position in the slot of the terminal. Retaining means serve to hold the terminal in its inserted position so that the pressure of the resilient member against the wire is maintained.

10 Claims, 8 Drawing Figures

ELECTRICAL CONNECTOR, ELECTRICAL TERMINAL AND A METHOD OF MAKING AN ELECTRICAL CONNECTION

This invention relates to an electrical connector, an electrical terminal and a method of making an electrical connection.

There is disclosed in U.S. Pat. No. 3,012,219, an electrical connector which comprises a housing and a terminal, the terminal having a slot into which an insulated electrical wire can be forced by inserting the terminal into the housing, to cause the insulation of the wire to be severed by the walls of the slot to make electrically conductive contact between the core of the wire and the slot, means being provided to retain the terminal in its inserted position in the housing.

Although such a connector can be used satisfactorily with a solid wire, i.e. a wire having a metal core consisting of a single strand, this known connector is unsuitable for use with a stranded wire i.e. a wire of which the core is composed of a multiplicity of strands, especially in an environment such as is to be found in automobiles and domestic appliances, where the connection formed between the terminal and the wire core is likely to be subject to vibration caused by a driving motor. As a result of the pressure exerted against the wire core by the slot walls, and the vibration, the strands of the wire core tend to move relative to the slot walls, so as to reduce the contact pressure exerted by the slot walls against the wire core, whereby the integrity of the connection is impaired.

According to one aspect of the invention, an electrical connector comprises a housing and a terminal, the terminal having a slot into which an insulated electrical wire can be forced by inserting the terminal along an insertion path into the housing, to cause the insulation of the wire to be severed by the walls of the slot to make electrically conductive contact between the core of the wire and the slot walls, a resilient pressure member being provided against the resilient action of which the wire can be forced into the slot and retaining means serving to retain the terminal in its inserted position in the housing to ensure that the pressure member resiliently maintains the wire in the slot subsequently to the insertion of the terminal.

According to another aspect of the invention an electrical terminal comprises a portion for mating with a further terminal, and a wire connecting portion, the wire connecting portion having a keyhole-shaped opening constituted by a part circular aperture and a parallel-sided slot of substantially less width than the radius of the part circular aperture, the parallel sided portion being directed towards the mating portion of the terminal, barbs being positioned on either side of the opening and presenting sharp edges directed towards the connecting portion.

According to a further aspect of the invention, in a method of making electrical connection to an insulated wire having a stranded, electrically conductive metal core, the wire is forced into a slot in a terminal by inserting the terminal into a housing through which the wire has been passed, so that the insulation of the wire is severed by the walls of the slot in the terminal whereby the walls of the slot make electrically conductive contact with the metal core of the wire, the wire being forced into the slot against the resilient action of a resilient pressure member and the terminal being subsequently retained in its inserted position in the housing in such a way that the resilient member cooperates with a closed end of the slot to restrain relative movement between the core of the wire and the slot walls.

For a better understanding of the invention, reference will now be made by way of example to the accompanying drawings, in which.

Figure 1:
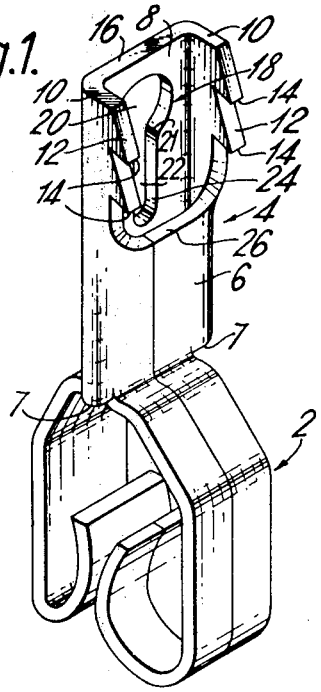
FIG. 1 is a perspective view of an electrical terminal.

As shown in FIG. 1, the terminal, which has been stamped and formed from a single piece of sheet metal stock, comprises a mating portion 2 in the form of a clip for receiving a flat electrical tab (not shown), surmounted by a wire connecting portion 4 comprising a hollow shank 6 of generally rectangular cross-section, connected at one end to the portion 2 and merging at its other end into a substantially U cross-section part 8, the arms 10 of the U being provided with barbs 12 pointing generally in the direction of the portion 2 and terminating in sharp edges 14. The base 16 of the part 8 is formed with a keyhole-shaped opening 18 constituted by a part circular aperture 20 remote from the portion 2, and a slot 22 between the aperture 20 and the mating portion 2 and having straight parallel side walls 24 which are spaced from one another by a distance which is substantially less than the radius of the aperture 20, there being convex transition walls 21 connecting the walls 24 and those of the aperture 20. The shank 6 is provided with abutment lugs 7.

Figure 2:
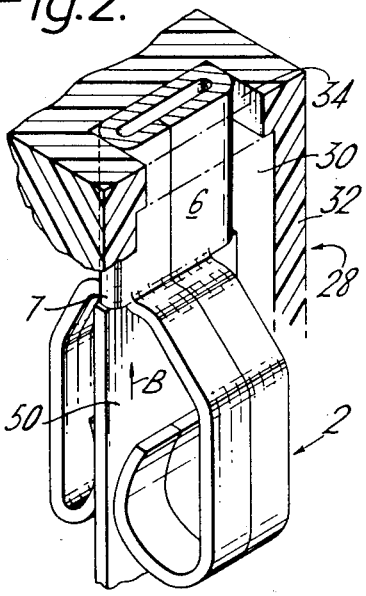
FIG. 2 is a perspective view in longitudinal section and in transverse section taken on the lines II—II of FIG. 3, of a first part of an electrical connector comprising a terminal according to FIG. 1, and showing a first part of a tool for inserting the terminal in the housing of the connector.
Figure 3:
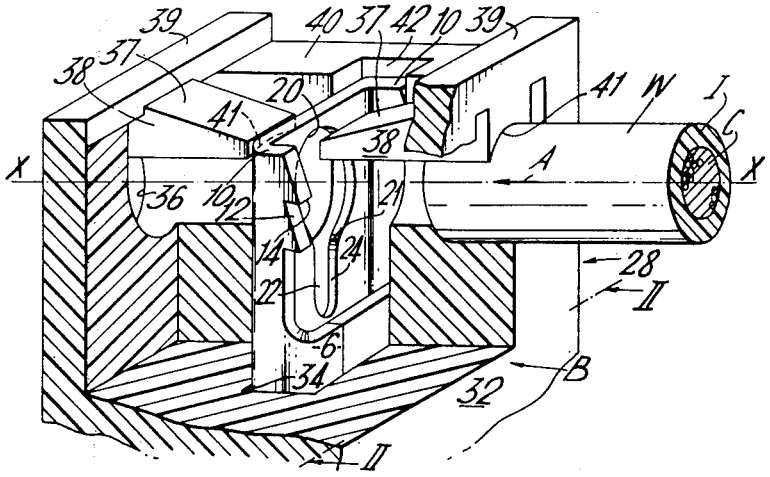
FIG. 3 is a perspective view of the remaining part of the connector, with a fragment of the housing removed to show a wire connecting portion of the terminal in a partially inserted position in the housing and an end portion of an insulated electrical wire about to be inserted through an aperture in such portion of the terminal.
Figure 4:
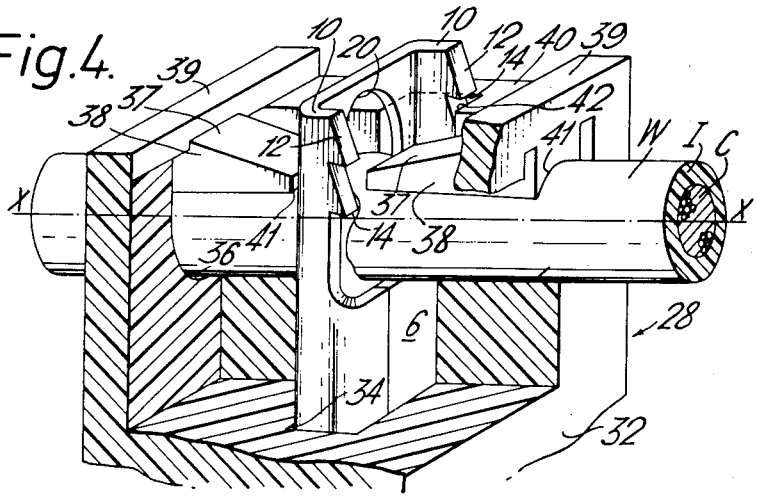
FIG. 4 is a similar view to that of FIG. 3 but showing the wire connecting portion when the terminal has been fully inserted in the housing and the wire end portion has been inserted through the aperture.

An insulating housing 28 for receiving the terminal 2, 4 and which has been molded in one piece from a synthetic plastics material has a cavity 30 (FIG. 2) dimensioned to accommodate the mating portion 2 of the terminal, the cavity 30 having a base wall 32 formed with a passage 34 communicating at one end with the cavity 30, and at the other end with an arcuate cross-section channel 36 extending through the upper (as seen in FIGS. 3 to 6) part of the base wall 32. Wedge-shaped resilient pressure members 38 extending inwardly of the housing 28 from ribs 39 spanning the channel 36, have arcuate surfaces 41 facing the channel 36, these surfaces having the same radius of curvature as, and a longitudinal axis X—X common with, the channel 36. Surfaces 37 of the members 38 opposite the surfaces 41 converge towards the channel 36, the ribs 39 being upstanding from the surfaces 37. Walls 40 of the housing 28, on either side of the pressure members 38 are each formed with a groove 42 extending longitudinally of the housing and communicating with the passage 34, the grooves 42 being dimensioned to accommodate the arms 10 of the terminal, as best seen in FIGS. 3 and 4.

Figure 5:
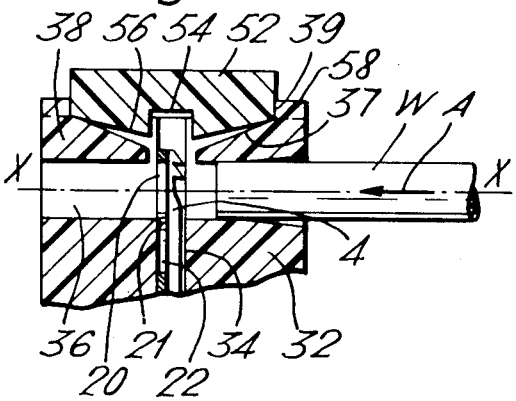
FIG. 5 is a fragmentary longitudinal sectional view through the connector, corresponding to FIG. 3 but drawn to a smaller scale and showing a second part of the tool.
Figure 7:
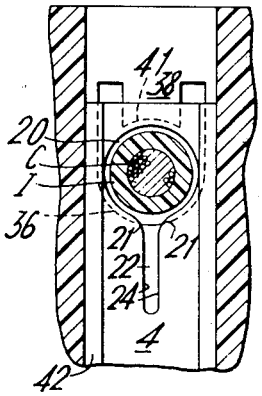
FIG. 7 is a fragmentary diagrammatic longitudinal sectional view corresponding to FIGS. 3 and 5 but taken at right-angles to FIG. 5.
Figure 6:
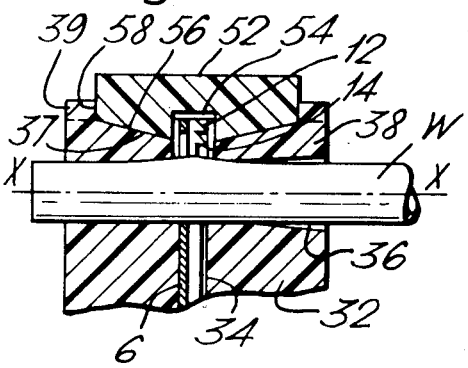
FIG. 6 is a similar view to that of FIG. 5 but corresponding to FIG. 4.

To assemble to terminal 2, 4, in the housing, and to connect the terminal to the stranded wire core C of an insulated wire W having insulation I, the portion 4 of the terminal is inserted through the cavity 30 and the passage 34 until the aperture 20 is aligned for the axis X—X, as shown in FIGS. 3, 5 and 7, and the end portion of the wire W is then inserted through the channel 36 (which has substantially the same radius as the wire W) in the direction of the arrow A in FIGS. 3 and 5, and thus through the aperture 20, which has, as best seen in FIG. 7, a somewhat larger diameter than the wire W, so that the free end of the wire extends leftwardly (as seen in FIGS. 4 and 6) from the housing 28.

A tool for inserting the terminal fully into the housing and for connecting the wire W to the terminal, comprises a first part 50 formed as a rectangular blade (FIG. 2) and a second part 52 (FIGS. 5 and 6) having a central recess 54 dimensioned freely to receive the free end portion of the portion 8 of the terminal and being bounded by convergent inclined surfaces 56 having the same angle of inclination as the surfaces 37. The tool part 52 also has opposite lateral faces 58 which are spaced so as to fit between the ribs 39. The remainder of the tool is not shown.

Figure 8:
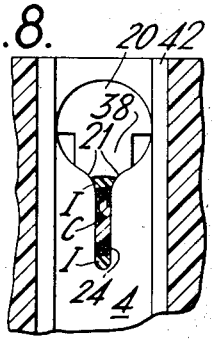
FIG. 8 is a similar view to that of FIG. 7 but corresponding to FIGS. 4 and 6.

With the tools parts 50 and 52 positioned, as shown in FIGS. 2 and 5, respectively, the tool is operated so that the part 50 is moved in the direction of the arrow B in FIG. 2 to force the terminal guided by the engagement of the side walls 10 in the grooves 42, from the position of FIGS. 3, 5 and 7 into that of FIGS. 4, 6 and 8, the tool part 52 meanwhile remaining in firm engagement with the surfaces 37 of the pressure members 38, after which the tool parts 50 and 52 are moved away from one another and the tool is withdrawn. During such relative movement between the terminal and the housing, the wire W is forced by the transition walls 21 of the opening 18, against the arcuate surfaces 41 of the pressure members 38 so that these members are urged, against the action of their own resilience, into engagement with the surfaces 56 of the tool part 52 so that the surfaces 37 and 56 lie in full surface-to-surface engagement.

The pressure members 38 serve to urge the wire down into the slot 22 so that the insulation I of the wire W is cut through by the walls 21 and the core C of the wire is forced between the walls 24 of the slot 22 and is simultaneously deformed to elongate shape, as shown in FIG. 8.

The sharp edges 14 of the barbs 12 are forced, when the insertion of the terminal into the housing has been completed, into the side walls of the grooves 42, by virtue of the resilient action of the pressure members 38 against the wire W, so that the terminal is retained in its fully inserted position in the housing. Thus after the tool has been withdrawn, as mentioned above, the pressure members 38 continue resiliently to engage the upper portion of the insulation, as shown in FIG. 8, thus retaining the core C in the slot portion 22, so that permanent electrically conductive contact is maintained between the wire core C and the slot walls 24. Since the wire core C is urged into the slot portion 22, against the resilient braking action of the members 38, the core C cannot be forced so abruptly into the slot portion 22, at least where a normal force is applied by the tool, that any substantial number of the wire strands of the core C are fractured.

The connector may comprise a plurality of terminals 2, 4, in a common housing, the connector and the tool being arranged so that the tool can act upon all the terminals simultaneously. The connector may be supplied to the user with the terminal or terminals positioned as in FIGS. 3, 5 and 7 and thus protected by the housing.

It will be apparent from the above description that pressure members 38 cooperate with the closed end of the slot portion 22 to restrain relative movement between the core C of the wire and the slot walls 24. The strands of the core C are therefore restrained from movement outwardly of the slot portion 22 so as to impair the integrity of the connection between the terminal and the core C. The connector is accordingly suitable for connecting stranded wires in an environment where there are forces e.g. resulting from vibration, which would tend to loosen the connection. Such an environment is to be found for example in the vicinity of an internal combustion engine.

What is claimed is:

1. An electrical connector comprising a housing and a terminal, the terminal having a slot into which an insulated electrical wire can be forced by inserting the terminal along an insertion path into the housing, to cause the insulation of the wire to be severed by the walls of the slot so that the walls engage either side of the core of the wire, a pair of resiliently flexible pressure members being provided against the resilient action of which the wire can be forced into the slot, said pressure members extending inwardly of the housing from opposite walls of the housing to which said pressure members are connected, said pressure members having free ends positioned adjacent to and lying on either side of the insertion path of the terminal, said pressure members having arcuate surfaces facing an arcuated cross-section guide channel for the wire, the channel and the arcuate surfaces having a common axis of curvature extending transversely of the insertion path, and retaining means serving to retain the terminal in its inserted position in the housing to ensure that the pressure member resiliently maintains the wire in the slot subsequently to the insertion of the terminal.

2. A connector according to claim 1, in which the retaining means for the terminal comprises barbs on the terminal which bite into the walls of grooves in the housing when the terminal has been inserted thereinto, under the resilient action of the pressure members to drive the barbs into the material of the housing.

3. A connector according to claim 1, in which the pressure members have inclined surfaces opposite the arcuate surfaces, the inclined surfaces of the two pressure members converging in the direction of the guide channel.

4. A connector according to claim 3, in which each pressure member projects from a rib extending at right-angles to the guide channel, each rib being upstanding from the inclined surface of the corresponding pressure member.

5. A method of making electrical connection to an insulated wire having a stranded, electrically conductive metal core, in which method the wire is forced into a slot in a substantially uniplanar plate portion of a terminal by inserting the terminal into a housing through which the wire has been passed, so that the insulation of the wire is severed by the walls of the slot in the plate portion whereby the walls of the slot engage the metal core of the wire on either side, the wire being forced into the slot against the resilient action of a resiliently flexible pressure member in the form of a cantilever beam projecting from the housing and supported by a tool member positioned on the opposite side of the pressure member to the wire and being separate from the housing and the terminal being subsequently retained in its inserted position in the housing in such a way that the pressure member cooperates with a closed end of the slot to restrain relative movement between the core of the wire and the slot walls.

6. An electrical connector comprising a housing and a terminal, the terminal having a slot into which an insulated electrical wire can be forced by inserting the terminal along an insertion path into the housing, to cause the insulation of the wire to be severed by the walls of the slot to make electrically conductive contact between the core of the wire and the slot walls, a resilient pressure member being provided against the resilient action of which the wire can be forced into the slot and retaining means serving to retain the terminal in its inserted position in the housing to ensure that the pressure member resiliently maintains the wire in the slot subsequently to the insertion of the terminal, the slot in the terminal communicating with a part circular aperture therein through which the wire can be inserted axially of its length, the radius of the aperture being substantially greater than the width of the slot, the slot being directed oppositely to the insertion direction of the terminal and the slot walls being connected to the walls of the aperture by concave walls.

7. An electrical connector comprising a combination, a housing, a terminal comprising a substantially uniplanar plate portion having a slot defined by a pair of smooth, opposed side walls and a base wall into which slot an insulated, multistranded electrical wire can be forced to cause the insulation of the wire to be severed by the side walls of the slot and the core of the wire to be engaged on each side by a side wall of the slot, first wall portions of the housing defining an elongate terminal insertion path, a resiliently deflectable pressure member connected to the housing and extending transversely of the insertion path adjacent one end thereof, the pressure member having a free end facing the plane of the plate portion, second wall portions of the housing defining a wire guide channel for axially guiding the wire, extending transversely of the terminal insertion path and intersecting it in the vicinity of the pressure member, which member lies between the one end of the path and the wire guide channel, the slot in the terminal plate portion extending longitudinally of the terminal insertion path whereby a wire inserted axially through the wire guide channel and thus across the terminal insertion path can be forced into the slot of the terminal plate portion by contact with one face of the pressure member, by advancing the terminal towards the one end of the insertion path and detent means on the terminal cooperating with the housing for retaining the terminal against withdrawal from its inserted position axially of the terminal insertion path, the pressure member being positioned resiliently to engage the wire with said one face to maintain the wire in the slot subsequently to the insertion of the terminal.

8. An electrical connector comprising in combination, a housing, a terminal in the form of a metal plate having a slot into which an insulated electrical wire can be forced to cause the insulation of the wire to be severed by the walls of the slot and the core of the wire to be engaged on each side by a wall of the slot, first wall portions of the housing defining an elongate terminal insertion path, a resiliently deflectable pressure member connected to the housing and extending transversely of the insertion path adjacent one end thereof, second wall portions of the housing defining a wire guide channel extending transversely of the path and communicating therewith in the vicinity of the pressure member, which member lies nearer to the one end of the path than the wire channel, the slot in the terminal extending longitudinally of the path whereby a wire inserted through the wire guide channel and across the terminal insertion path can be forced into the slot of the terminal by advancing the terminal towards the one end of the insertion path and means for retaining the terminal in its inserted position, the pressure member serving resiliently to maintain the wire in the slot subsequently to the insertion of the terminal, the resiliently deflectable pressure member having an arcuate surface facing the wire guide channel which is of arcuate cross-section, the wire guide channel and the arcuate surfaces having a common axis of curvature extending transversely of the insertion path.

9. A connector according to claim 8, in which a plurality of resiliently deflectable pressure members are provided, each extending from an opposite internal wall of the housing and having an inclined surface opposite to its arcuate surfaces, the inclined surfaces of the pressure members converging in the direction of the guide channel and each pressure member extending from a rib extending at right angles to the guide channel, each rib being upstanding from the inclined surface of the corresponding pressure member.

10. A terminal according to claim 9, in which the retaining means for the terminal comprises barbs on the terminal which bite into the walls of grooves in the housing when the terminal has been inserted into the housing, under the resilient action of the pressure member, the barbs projecting from a free edge of a flange formed integrally with the plate and extending generally at right angles thereto.

* * * * *